US012760387B2

(12) United States Patent
Lee et al.

(10) Patent No.: US 12,760,387 B2
(45) Date of Patent: Oct. 13, 2026

(54) STEEL MATERIAL FOR HOT FORMING, HOT-FORMED MEMBER, AND MANUFACTURING METHOD THEREFOR

(71) Applicant: POSCO CO., LTD, Pohang-si (KR)

(72) Inventors: Sea-Woong Lee, Gwangyang-si (KR); Jin-Keun Oh, Gwangyang-si (KR); Seong-Woo Kim, Gwangyang-si (KR); Sang-Heon Kim, Gwangyang-si (KR); Hyo-Sik Chun, Gwangyang-si (KR); Sang-Bin Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 33 days.

(21) Appl. No.: 18/286,166

(22) PCT Filed: Aug. 12, 2022

(86) PCT No.: PCT/KR2022/012070
§ 371 (c)(1),
(2) Date: Oct. 9, 2023

(87) PCT Pub. No.: WO2023/022445
PCT Pub. Date: Feb. 23, 2023

(65) Prior Publication Data

US 2024/0182996 A1 Jun. 6, 2024

(30) Foreign Application Priority Data

Aug. 19, 2021 (KR) ..... 10-2021-0109302

(51) Int. Cl.
*C22C 38/00* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C22C 38/001; C22C 38/002; C22C 38/02; C22C 38/04; C22C 38/06; C22C 38/22; C22C 38/28; C22C 38/32
(Continued)

(56) References Cited

U.S. PATENT DOCUMENTS 6,296,805 B1 10/2001 Laurent et al.
2014/0056754 A1 2/2014 Naitou et al.
(Continued)

FOREIGN PATENT DOCUMENTS

CN 109072375 A 12/2018
CN 110073027 A 7/2019
(Continued)

OTHER PUBLICATIONS

Dobrzynski et al., "Surface Texture after Turning for Various Workpiece Rigidities", MPDI, Jan. 12, 2021, URL: <https://www.mdpi.com/2075-1702/9/1/9>, pp. 1-10 (Year: 2021).*
(Continued)

*Primary Examiner* — Katherine A Christy
(74) *Attorney, Agent, or Firm* — Morgan Lewis & Bockius LLP

(57) ABSTRACT

A steel material for hot forming including, by weight: 0.04 to 0.45% of carbon (C); 1.5% or less of silicon (Si) (excluding 0%); 0.2 to 2.5% of manganese (Mn); 0.05% or less of phosphorous (P); 0.02% or less of sulfur (S); 0.01 to 0.1% of aluminum (Al); 0.01 to 5.0% of chromium (Cr); 0.02% or less of nitrogen (N), and a balance of iron (Fe) and inevitable
(Continued)

impurities. A surface roughness factor calculated by the following [Relationship 1] is 1.8 μm or less:

$$\text{Surface Roughness Factor} = \frac{Rt}{100} + 10 \times Rdq \qquad \text{[Relationship 1]}$$

where Rt is defined as a vertical distance between a highest peak and a deepest valley in a random measurement section on a surface of a steel sheet, and Rdq is a root mean square of a slope of the peak in a random measurement section on the surface of the steel sheet.

6 Claims, 2 Drawing Sheets

(51) Int. Cl.

| | |
|---|---|
| ***C21D 8/02*** | (2026.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C23C 2/02*** | (2006.01) |
| ***C23C 2/12*** | (2006.01) |
| ***C23C 2/40*** | (2006.01) |

(52) U.S. Cl.
CPC ..... *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/32* (2013.01); *C23C 2/0224* (2022.08); *C23C 2/12* (2013.01); *C23C 2/40* (2013.01)

(58) Field of Classification Search
USPC ..... 428/653
See application file for complete search history.

(56) References Cited

U.S. PATENT DOCUMENTS

| | | | |
|---|---|---|---|
| 2014/0342185 | A1 | 11/2014 | Nonaka et al. |
| 2016/0318093 | A1 | 11/2016 | Maki et al. |
| 2016/0362763 | A1 | 12/2016 | Oh et al. |
| 2018/0044754 | A1 | 2/2018 | Azuma et al. |
| 2019/0127820 | A1 | 5/2019 | Hasegawa et al. |
| 2020/0024748 | A1 | 1/2020 | Kubo et al. |
| 2020/0071809 | A1 | 3/2020 | Jeon et al. |
| 2021/0002751 | A1 | 1/2021 | Kim et al. |
| 2021/0164080 | A1 | 6/2021 | Fujita et al. |

FOREIGN PATENT DOCUMENTS

| | | | |
|---|---|---|---|
| CN | 111527232 | A | 8/2020 |
| JP | H03-184605 | A | 8/1991 |
| JP | H06-15302 | A | 1/1994 |
| JP | H07-278655 | A | 10/1995 |
| JP | 2000-38640 | A | 2/2000 |
| JP | 2007-211276 | A | 8/2007 |
| JP | 2008-261032 | A | 10/2008 |
| JP | 2008-274360 | A | 11/2008 |
| JP | 2013-14842 | A | 1/2013 |
| KR | 10-2001-0060423 | A | 7/2001 |
| KR | 10-1569508 | B1 | 11/2015 |
| KR | 10-2016-0078851 | A | 7/2016 |
| KR | 10-2016-0095078 | A | 8/2016 |
| KR | 10-2017-0122823 | A | 11/2017 |
| KR | 10-2019-0085137 | A | 7/2019 |
| KR | 10-2021-0080239 | A | 6/2021 |
| WO | 2013/105638 | A1 | 7/2013 |
| WO | 2016/104881 | A1 | 6/2016 |
| WO | 2019/111931 | A1 | 6/2019 |

OTHER PUBLICATIONS

Goritskii et all, "Nature of Anisotropy of Impact Toughness of Structural Steels with Ferrite-Pearlite Structure", The Physics of Metals and Metallurgy, vol. 114 No. 10, Feb. 26, 2013, URL: <https://link.springer.com/content/pdf/10.1134/S0031918X13100037.pdf>, pp. 877-883, (Year: 2013).*

Japanese Office Action dated Aug. 6, 2024 issued in Japanese Patent Application No. 2023-539091 (with English translation).

International Search Report dated Nov. 21, 2022, issued in International Patent Application No. PCT/KR2022/012070 (with English translation).

Office Action dated Sep. 18, 2025 issued in the corresponding Chinese Patent Application No. 202280014777.6. (Note: KR 10-2021-0080239 A, and KR 10-2001-0060423 A already submitted.).

Decision of Grant dated Mar. 23, 2026 issued in the corresponding Chinese Patent Application No. 202280014777.6.

* cited by examiner

[FIG. 1]
$$Rt = \max(Zpi) + \max(Zvi)$$
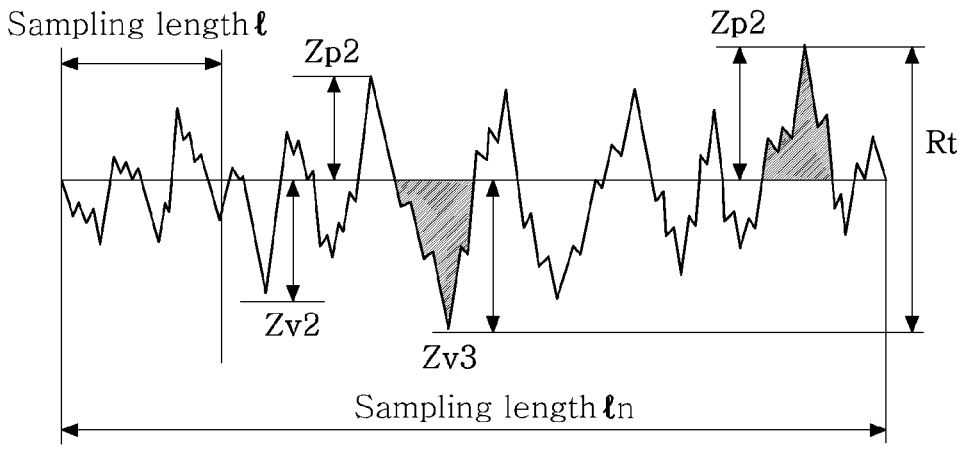
$$Rdq = \sqrt{\frac{1}{\ell}\int_0^{\ell}\left(\frac{d}{dx}Z(x)\right)^2 dx}$$
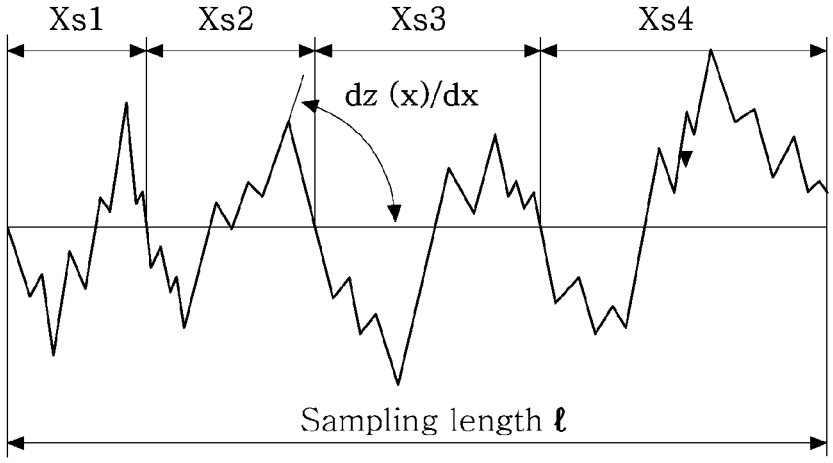

[FIG. 2]
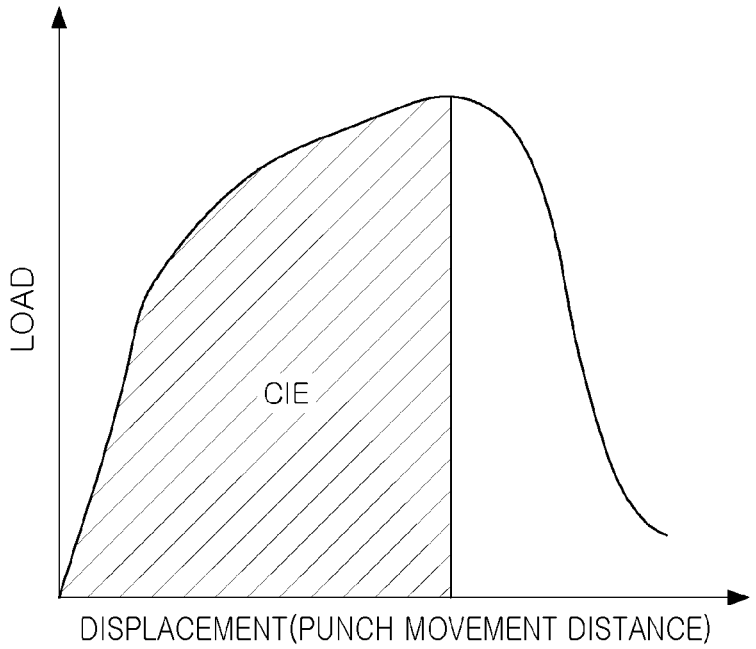

STEEL MATERIAL FOR HOT FORMING, HOT-FORMED MEMBER, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2022/012070, filed on Aug. 12, 2022, which in turn claims the benefit of Korean Application No. 10-2021-0109302, filed on Aug. 19, 2021, the disclosures of which applications are incorporated by reference herein.

TECHNICAL FIELD

The present disclosure relates to a steel material for hot forming, used for a vehicle, and the like, a hot-formed member, and a manufacturing method therefor.

BACKGROUND ART

Recently, efforts have been made to improve fuel efficiency by reducing the weight of vehicles. To this end, a thickness of a steel material may be reduced, but if the thickness thereof is reduced, a problem may occur in stability of the vehicles, so improvement in the strength of the steel material should be supported. For this reason, a demand for high-strength steel sheets has been continuously generated, and various types of steel materials have been developed. However, since these steel materials have high strength, there is a problem in that workability is poor.

In order to solve this problem, a hot forming method has been proposed. The hot forming method is a method of processing the steel material at a high temperature, suitable for processing the steel material, and then rapidly cooling the same to a low temperature to form a low-temperature structure such as martensite, or the like, in the steel material, thereby increasing strength of a final product. In this case, it is possible to minimize a problem of workability when manufacturing a member having high strength.

As a technology related to such hot forming, provided is Patent Document 1. Patent Document 1 proposes a technology of securing ultra-high strength having a tensile strength of 1600 MPa or more, by heating an Al—Si plated steel sheet to 850° C. or higher and then forming a member structure into martensite by hot forming and rapid cooling by pressing.

Meanwhile, the hot-formed member used for the purpose of protecting passengers should have excellent impact resistance, and bendability is widely used a as representative index for evaluating such impact resistance. For example, in the case of a vehicle B-pillar, when a hot-formed member is bent by a side impact of a vehicle, characteristics (bendability) capable of withstanding a certain distance (angle) or more without breaking are required.

Patent Document 2 proposes a method of controlling a ferrite structure of a surface layer of a hot-formed member, and in addition thereto, in order to supplement the relatively poor energy absorption capacity, a technology to incorporate a blank (tailor welded blank, TWB) having a combination of different materials or different thicknesses into hot forming has been suggested, and various studies are being conducted.

However, structural control of ferrite of the surface layer by optimizing hot forming conditions has limitations in improving bendability. In addition, even in the improvement of impact resistance through TWB, there has been a limitation in improving the characteristics of parts requiring impact resistance, such as rather inferior bendability due to deterioration of welded parts.

(Patent Document 1) U.S. Pat. No. 6,296,805

(Patent Document 2) Korea Patent Registration No. 10-1569508

SUMMARY OF INVENTION

Technical Problem

An aspect of the present disclosure is to provide a steel material for hot forming in which a hot-formed member has high strength and simultaneously having excellent bendability, a hot-formed member manufactured using the same, and a manufacturing method therefor.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, provided is a steel material for hot forming, the steel material for hot forming comprising, by weight: 0.04 to 0.45% of carbon (C); 1.5% or less of silicon (Si) (excluding 0%); 0.2 to 2.5% of manganese (Mn); 0.05% or less of phosphorous (P); 0.02% or less of sulfur (S); 0.01 to 0.1% of aluminum (Al); 0.01 to 5.0% of chromium (Cr); 0.02% or less of nitrogen (N), and a balance of Fe and inevitable impurities, wherein a surface roughness factor calculated by the following [Relationship 1] is 1.8 μm or less, $$\text{Surface Roughness Factor} = \frac{Rt}{100} + 10 \times Rdq \qquad \text{[Relationship 1]}$$

where, Rt is defined as a vertical distance between the highest peak and the deepest valley in a random measurement section on a surface of a steel sheet, and Rdq is a root mean square of a slope of the peak in a random measurement section on the surface of the steel sheet.

According to another aspect of the present disclosure, provided is a method for manufacturing a steel material for hot forming, the method comprising operations of: obtaining a cold-rolled steel sheet using a steel slab comprising, by weight: 0.04 to 0.45% of carbon (C); 1.5% or less of silicon (Si) (excluding 0%); 0.2 to 2.5% of manganese (Mn); 0.05% or less of phosphorous (P); 0.02% or less of sulfur (S); 0.01 to 0.1% of aluminum (Al); 0.01 to 5.0% of chromium (Cr); 0.02% or less of nitrogen (N), and a balance of Fe and inevitable impurities; and skin pass rolling the cold-rolled steel sheet to satisfy the following [Relationship 2], $$\sqrt{P \times Ra_{roll}} \leq 40, \ (\text{ton} \cdot \mu\text{m})^{1/2} \qquad \text{[Relationship 2]}$$

where P is rolling force during skin pass rolling, and $Ra_{roll}$ is arithmetic average roughness (Ra) of a skin pass rolling roll.

According to another aspect of the present disclosure, provided is a hot-formed member, the hot-rolled member comprising by weight: 0.04 to 0.45% of carbon (C); 1.5% or less of silicon (Si) (excluding 0%); 0.2 to 2.5% of manganese (Mn); 0.05% or less of phosphorous (P); 0.02% or less of sulfur (S); 0.01 to 0.1% of aluminum (Al); 0.01 to 5.0% of chromium (Cr); 0.02% or less of nitrogen (N), and a balance of Fe and inevitable impurities, wherein a change amount of a maximum bending angle is 5% or less.

According to another aspect of the present disclosure, provided is a method for manufacturing a hot-formed member, the method comprising: obtaining a blank using the steel material for hot forming described above;

heating the blank to a temperature of Ac3 to 980° C., and then maintaining the temperature for 1 to 1000 seconds; and hot forming the heated and maintained blank and then cooling the blank.

Advantageous Effects of Invention

As set forth above, according to the present disclosure, it is possible to manufacture a hot-formed member having high strength after hot forming and simultaneously having excellent bendability and excellent impact resistance. It is possible to provide a steel material for hot forming for this purpose, a hot-formed member manufactured therefrom, and a manufacturing method thereof.

The means for solving the above problems do not enumerate all the features of the present invention, and the various features of the present invention and the advantages and effects thereof will be understood in more detail with reference to the specific embodiments and examples below.

BRIEF DESCRIPTION OF DRAWINGS

FIG. 1 simply illustrates a concept of surface roughness factors of [Relationship 1] proposed in the present disclosure.

FIG. 2 simply illustrates the concept of crack initiation energy (CIE), which is a criterion for evaluating a impact energy absorption capacity in the present disclosure.

BEST MODE FOR INVENTION

The terms used herein are intended to describe the present disclosure and are not intended to limit the present invention. In addition, the singular forms used herein comprise the plural forms unless the related definition clearly dictates the contrary.

The meaning of "comprising" as used in the specification specifies a component, and does not exclude the presence or addition of other components Unless otherwise defined, all terms comprising technical terms and scientific terms used in this specification have the same meaning as commonly understood by a person of ordinary skill in the art to which the present invention belongs. The terms defined in the dictionary are interpreted to have a meaning consistent with the related technical literature and the currently disclosed content.

First, an embodiment of a steel material for hot forming of the present disclosure will be described in detail. The steel material of the present disclosure may comprise, by weight: 0.04 to 0.45% of carbon (C); 1.5% or less of silicon (Si) (excluding 0%); 0.2 to 2.5% of manganese (Mn); 0.05% or less of phosphorous (P); 0.02% or less of sulfur (S); 0.01 to 0.1% of aluminum (Al); 0.01 to 5.0% of chromium (Cr); 0.02% or less of nitrogen (N), and a balance of Fe and inevitable impurities. Hereinafter, each alloy composition will be described in detail. Hereinafter, % herein represents % by weight.

Carbon (C): 0.04 to 0.45%

Carbon (C) is an essential element added for improving strength of a member. If a content of C is less than 0.04%, it is difficult to secure sufficient strength, and ultimately, even if bendability is high, an impact energy absorption capacity is rather low, so carbon (C) is preferably added in 0.04% or more. On the other hand, when the C content is more than 0.45%, the strength is increased, but the bendability is lowered, so the impact energy absorption capacity is lowered, so the content of C is preferably less than 0.45%.

Silicon (Si): 1.5% or Less (Excluding 0%)

Silicon (Si) should be added as a deoxidizer in steelmaking, as well as a solid solution and a carbide formation inhibiting element, contributing to an increase in strength of a hot-formed member and being added as an effective element for material uniformity. When a content of Si is more than 1.5%, plating properties may be deteriorated due to Si oxides generated on a surface of the steel sheet during annealing. Accordingly, Si is preferably comprised in an amount of 1.5% or less (excluding 0%).

Manganese (Mn): 0.2 to 2.5%

Manganese (Mn) needs to be added not only for securing a solid solution strengthening effect, but also suppressing ferrite formation during hot forming through improving hardenability. If a content of Mn is less than 0.2%, there is a limitation in obtaining the above effect, and other expensive alloy elements are excessively required to improve insufficient hardenability, which may cause a problem of greatly increasing manufacturing costs. On the other hand, when the content of Mn is more than 2.5%, the strength of the steel sheet before the hot forming process may decrease due to an increase in cold rolling properties, and a band-like structure arranged in a rolling direction deepens, and the impact energy absorbing capacity may become inferior. Therefore, the content of Mn is preferably 0.2 to 2.5%.

Phosphorous (P): 0.05% or Less

Phosphorous (P) is present as impurities in a steel, and when a content of P is more than 0.05%, weldability of a hot-formed member may be greatly weakened. Meanwhile, P is an inevitable impurity in manufacturing a steel material, and a lower limit thereof may not be particularly limited. However, since a lot of manufacturing costs may be required to control the content of P to be less than 0.001%, the content of P may be 0.001% or more.

Sulfur (S): 0.02% or Less

Sulfur (S) present as an impurity in steel, and an element which impairs ductility, impact properties, and weldability of the hot-formed member, so a content of S is preferably limited to 0.02% at most. Meanwhile, S is an inevitable impurity, and a lower limit thereof may not be particularly limited, but in order to control the content of S to less than 0.0001%, it may take much manufacturing costs, and thus, the content of S may be 0.0001% or more %.

Aluminum (Al): 0.01 to 0.1%

Aluminum (Al) is an element acting as a deoxidizer in steelmaking to increase cleanliness of a steel, together with Si. When a content of Al is less than 0.01%, it is difficult to obtain the above effect, and when the content of Al is more than 0.1%, there is a problem in that high-temperature ductility due to excessive AlN formed during a casting process deteriorates and slab cracks occur. Therefore, the content of Al is preferably 0.01 to 0.1%.

Chromium (Cr): 0.01 to 5.0%

Cr is added for securing hardenability of steel like Mn, and to secure a beautiful surface during an HPF process. If a content of Cr is less than 0.01%, it may be difficult to secure sufficient hardenability. On the other hand, if the content of Cr is more than 5.0%, an effect of improving the hardenability compared to an addition amount is insignificant, and it may promote formation of coarse Cr-based carbides to deteriorate impact energy absorption ability, so it is preferable that the content of Cr does not exceed 5.0%.

Nitrogen (N): 0.02% or Less

Nitrogen (N) is comprised as an impurity in steel. When a content of N is more than 0.02%, there is a problem in that slab cracks due to AlN formation easily occur, as in the case of Al above. N is an impurity, and a lower limit thereof may not be particularly limited, but may be 0.001% or more because a lot of manufacturing costs may be required to manage the content of N to be less than 0.001%.

Meanwhile, the steel material may further comprise one or more of 0.5% or less of Mo, 0.5% or less of Ni, 0.1% or less of Nb, 0.1% or less of Ti, and 0.01% or less of B, in addition to the above-described alloy components.

Molybdenum (Mo): 0.5% or Less

Molybdenum (Mo) not only has an effect of improving hardenability of steel, such as Cr and Mn, but also has an effect of increasing bendability by refining crystal grains through formation of fine precipitates. However, when the content of Mo is more than 0.5%, it causes an excessive increase in ferroalloy cost compared to the effect, so it is preferable that the content thereof does not exceed 0.5%. The content of Mo is more preferably 0.45% or less, more preferably 0.4% or less, and still more preferably 0.35% or less.

Nickel (Ni): 0.5% or Less

Nickel (Ni) is an austenite stabilizing element, and hardenability of steel can be improved through addition of Ni. However, since Ni is an expensive alloy element, considering an increase in manufacturing cost compared to an effect of improving hardenability, an upper limit of the content of Ni is preferably set to 0.5%. Meanwhile, in order to sufficiently obtain the effect of improving hardenability according to the addition of Ni, the content of Ni is preferably at least 0.01% or more, more preferably 0.03% or more, and more preferably 0.05% or more. The upper limit of Ni is more preferably 0.45%, still more preferably 0.4%, and most preferably 0.35%.

Niobium (Nb): 0.1% or Less

Niobium (Nb) is element capable of obtaining a precipitation hardening effect through formation of fine precipitates, and thereby, an effect of improving bendability by increasing strength and refining crystal grains can be obtained. In addition, by suppressing excessive crystal grain growth during heating for hot forming, it is possible to promote robustness against variations in heat treatment conditions. However, when a content of Nb is more than 0.1%, not only the effect is saturated, but also relatively coarse precipitates increase due to an increase in precipitation temperature, which may reduce cost effectiveness. Therefore, the content of Nb is preferably 0.1% or less. A lower limit of the content of Nb is preferably 0.005%, more preferably 0.01%, and still more preferably 0.015%. An upper limit of the content of Nb is more preferably 0.09%, still more preferably 0.08%, and most preferably 0.07%.

Titanium (Ti): 0.1% or Less

Titanium (Ti) is an element that is also added together when B is added to secure hardenability by combining with nitrogen remaining as an impurity in steel to produce TiN. In addition, through formation of TiC precipitates, precipitation strengthening and grain refinement effects may be expected. However, if a content of Ti is more than 0.1%, a large amount of coarse TiN is formed to deteriorate an impact energy absorption capacity, so an upper limit thereof is preferably 0.1%. A lower limit of Ti is preferably 0.005%, more preferably 0.01%, and still more preferably 0.015%. An upper limit of Ti is more preferably 0.08%, more preferably 0.06%, and most preferably 0.05%.

Boron (B): 0.01% or Less

Boron (B) is an element that can improve hardenability even with addition of a small amount and is segregated at a prior austenite grain boundary and can effectively suppress brittleness of a hot-formed member due to grain boundary segregation of P and/or S. however, if a content of B is more than 0.01%, it is preferable that an upper limit thereof is 0.01%, because it caused brittleness in hot rolling, due to formation of a $Fe_{23}CB_6$ composite compound. Meanwhile, a lower limit of the content of B is preferably 0.0001%, more preferably 0.0003%, and still more preferably 0.0005%. An upper limit of the content of B is more preferably 0.009%, still more preferably 0.007%, and most preferably 0.005%.

A remainder of the present disclosure may be iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

The steel material for hot forming of the present disclosure, and preferably has a surface roughness factor of 1.8 μm or less, which is defined by the following [Relationship 1]. Surface roughness is expressed in various manners (Ra, Rt, Rsk, and the like), but it is difficult to improve bendability of a hot-formed member by simply changing Ra, Rsk, and the like, of a steel material. As a result of studying improvement of the bendability of the hot-formed member, the inventors of the present disclosure have recognized that the bendability of the hot-formed member may be improved when the surface roughness of the steel material is constantly managed. In order to secure the bendability of the hot-formed member, rather than simply measuring Rt and Rdq, the technical relationship between Rt and Rdq was derived to derive a surface roughness factor of [Relationship 1] below. Accordingly, in order to improve the bendability for increasing the impact energy absorption capacity of the hot-formed member, it is preferable that the surface roughness factor of the hot-formed steel material is 1.8 μm or less. When the surface roughness factor is more than 1.8 μm, a slope of a peak increases and the bendability may deteriorate due to maximization of a surface notch effect during bending.

$$\text{Surface Roughness Factor} = \frac{Rt}{100} + 10 \times Rdq \qquad \text{[Relationship 1]}$$

where Rt is defined as a vertical distance between a highest peak and a deepest valley in any measurement section on a surface of the steel sheet, and Rdq refers to a root mean square of the slope of the peak in any measurement section on the surface of the steel sheet. An example of a calculation method of Rt and Rdq according to the Relationship 1 is shown in FIG. 1, and a person skilled in the art has no difficulty in deriving the Rt and Rdq thereby.

A microstructure of the steel material for hot forming of the present disclosure may comprise, by area fraction: one or more of 50 to 90% of ferrite, 30% or less of pearlite, 20% or less of bainite, and 20% or less of martensite.

The ferrite is a soft phase and a structure effective for reducing a blanking process load of a steel sheet in blank manufacture, and in order to obtain the effect, it is preferable to secure 50% by area or more of ferrite. However, when ferrite is more than 90% by area, carbon is unduly distributed as a structure other than ferrite in blank manufacturing, so that carbon may be unevenly distributed even after hot forming. Therefore, it is preferable that the ferrite is in a range of 50 to 90% by area.

When the pearlite is more than 30% by area, cementite is incompletely dissolved after hot forming to decrease strength or cause non-uniformity of a material. When the bainite and the martensite are more than 20% by area, respectively, the strength of the steel sheet is excessively increased to cause problems such as mold wear in blank manufacturing.

Meanwhile, the steel material for hot forming of the present disclosure may comprise a plating layer on at least one surface, and the type of plating layer, such as a zinc (Zn)-based plating layer, an aluminum (Al)-based plating layer, and the like, is not particularly limited, and a method thereof such as hot-dip plating, electroplating, and the like, is not particularly limited. Preferably, for example, an Al-based plating layer may be formed. The Al-based plating is not particularly limited, but as an example, the Al-based plating layer may comprise, by weight: 6 to 12% of Si, 1 to 4% of Fe, and a balance of Al and inevitable impurities.

Next, an embodiment of a steel material for hot forming of the present disclosure will be described in detail. A method for manufacturing the same described below is only one embodiment of all possible embodiments, and does not mean that the steel material for hot forming of the present disclosure must be manufactured using only the following manufacturing method.

A cold-rolled steel sheet is manufactured and obtained by using a steel slab satisfying the above-described alloy composition, and the cold-rolled steel sheet is skin pass rolled to satisfy the following [Relationship 2] to manufacture a steel material.

$$\sqrt{P \times Ra_{roll}} \leq 40,\ (\text{ton} \cdot \mu\text{m})^{1/2} \qquad \text{[Relationship 2]}$$

where P is rolling force during skin pass rolling, and $Ra_{roll}$ is arithmetic average roughness (Ra) of a skin pass rolling roll.

By performing skin pass rolling on the cold-rolled steel sheet, the surface roughness of the steel material is controlled. In the present disclosure, it is recognized that material may be optimized in a surface of the steel consideration of technical action of rolling force (P) and the arithmetic mean roughness ($Ra_{roll}$) of the roll during skin pass rolling, and [Relationship 2] is derived. The rolling force (P) during the skin pass rolling is an important factor, but an upper or lower limit thereof is not particularly limited in the present disclosure. However, for example, when rolling force is not applied, there may be issues such as coiling failure, so the rolling force may be 100 tons or more, and more preferably 150 tons or more. In addition, when the rolling force is too high, there may be a phenomenon in which a surface plating layer cracks, and when the rolling force is more than 40 tons according to [Relationship 2], the upper limit thereof may be limited. For example, when the arithmetic average roughness of the skin pass rolling roll is 4 μm, the rolling force is preferably 400 tons or less in order to satisfy the above [Relationship 2].

The cold-rolled steel sheet may be obtained through a process such as heating, hot rolling, coiling, cooling, cold rolling, and annealing of the steel slab. Hereinafter, each process is explained.

Heating Steel Slab

The steel slab is heated at 1050 to 1300° C. When a heating temperature of the steel slab is lower than 1050° C., not only it may be difficult to homogenize a structure of the steel slab, but also it may be difficult to re-dissolve the same when using precipitated elements. On the other hand, when the heating temperature thereof is more than 1300° C., an excessive oxide layer is formed, which may increase the possibility of causing surface defects after hot rolling. Therefore, the heating temperature of the steel slab is preferably 1050 to 1300° C. A lower limit of the heating temperature of the steel slab is more preferably 1070° C., and still more preferably 1100° C. An upper limit of heating temperature of the steel slab is more preferably 1280° C., and still more preferably 1250° C.

Hot Rolling

The heated steel slab is hot-rolled and finish hot-rolled at 800 to 950° C., to obtain a hot-rolled steel sheet. When the finish hot rolling temperature is lower than 800° C., it may be difficult to control a plate shape due to occurrence of a mixed structure on a surface layer portion of the steel sheet due to two-phase region rolling. On the other hand, when the finish hot rolling temperature is higher than 950° C., there may be a problem in that crystal grain coarsening by hot rolling easily occurs. Therefore, the finish hot rolling temperature is preferably 800 to 950° C. A lower limit of the finish hot rolling temperature is more preferably 810° C., and still more preferably 820° C. An upper limit of the finish hot rolling temperature is more preferably 940° C., and still more preferably 930° C.

Coiling

The hot-rolled steel sheet is coiled at 500 to 700° C. If the coiling temperature is lower than 500° C., martensite is formed wholly or partially on the steel sheet, so that not only it is difficult to control a plate shape, but also a problem of poor rollability in a subsequent cold rolling process may occur due to an increase in strength of the hot-rolled steel sheet. If the coiling temperature is less than 500° C., martensite is formed wholly or partially on a steel sheet, so that not only it is difficult to control a plate shape, but also a problem of poor rollability in a subsequent cold rolling process may occur due to an increase in strength of the hot-rolled steel sheet. On the other hand, if the coiling temperature is higher than 700° C., coarse carbides may be formed, so that the impact energy absorption capacity of the hot-formed member may be deteriorated. Therefore, the coiling temperature is preferably 500 to 700° C. A lower limit of the coiling temperature is more preferably 520° C., and still more preferably 550° C. An upper limit of the coiling temperature is more preferably 680° C., and still more preferably 650° C.

Cooling

The coiled hot-rolled steel sheet is cooled (hot-rolled cooled) at a cooling rate of 10° C./Hr or more from a coiling temperature to 400° C., but when the cooling rate is less than 10° C./Hr, a disadvantage in that a large number of coarse carbides may be formed during cooling of a hot-rolled coil due to a sufficient time to grow carbides. Therefore, the cooling rate is preferably 10° C./Hr or more, more preferably 12° C./Hr or more, and still more preferably 15° C./Hr or more. Meanwhile, in the present disclosure, as long as the cooling rate is 10° C./Hr or more, the effect to be obtained in the present disclosure may be obtained, and thus, an upper limit thereof is not particularly limited.

Meanwhile, after the cooling, a process of pickling before cold rolling may be added. Surface quality of a product may be improved by removing scales formed on a surface of the steel sheet through the pickling process.

Cold Rolling

After the above process, the hot-rolled steel sheet is cold-rolled to obtain a cold-rolled steel sheet. In the present disclosure, a reduction rate during the cold rolling is not particularly limited, but a reduction rate of 30 to 80% may be applied to obtain a target thickness of the steel sheet.

Annealing and Cooling

Annealing is performed on the cold-rolled steel sheet, and for this purpose, the cold-rolled steel sheet is heated, and in this case, it is preferable to heat a temperature range from 400° C. to an annealing temperature at a rate of 20° C./s or less. When a heating rate from 400° C. to the annealing temperature is more than 20° C./s, there is not sufficient time for carbides precipitated in the hot-rolling step to be solid-solubilized again, so that a coarse carbide remains, and impact energy absorbing capacity of the finally obtained hot-formed member may be poor. Therefore, it is preferable that the heating rate from 400° C. to an annealing temperature is 20° C./s or less. The heating rate is more preferably 18° C./s or less, and still more preferably 15° C./s or less. Meanwhile, in the present disclosure, as long as the heating rate is 20° C./s or less, the effect to be obtained in the present disclosure may be obtained, and thus, a lower limit of the heating rate is not particularly limited. However, considering annealing productivity, the heating rate may be 0.5° C./s or more, more preferably 1° C./s or more, and still more preferably 1.5° C./s or more. Meanwhile, in the present disclosure, in the temperature range of a cold rolling temperature to less than 400° C., the heating rate is not particularly limited, since the effect of carbide re-solid solubilization is insignificant even when the heating rate is controlled.

It is preferable that the heated cold-rolled steel sheet is annealed at an annealing temperature of 740 to 860° C. when the annealing temperature is lower than 740° C., recrystallization of the cold rolled structure is insufficient, a plate shape becomes poor or strength after plating is excessively increased, and thus, mold wear during a blanking process may be caused. On the other hand, if the annealing temperature is higher than 860° C., since surface oxides such as Si and Mn may be formed during the annealing process and a problem of poor plating surface may occur, the annealing temperature is preferably 740 to 860° C. On the other hand, if the annealing temperature is higher than 860° C., since surface oxides such as Si and Mn may be formed during the annealing process and a problem of poor plating surface may occur, the annealing temperature is preferably 740 to 860° C. A lower limit of the annealing temperature is more preferably 750° C., and still more preferably 760° C. An upper limit of the annealing temperature is more preferably 850° C., and still more preferably 840° C.

It is preferable that the atmosphere during the annealing is preferably a non-oxidizing atmosphere. For example, a hydrogen-nitrogen mixture gas may be used, and in this case, a dew point temperature of the atmospheric gas may be −70 to −30° C. In order for the dew point temperature to be less than −70° C., additional equipment for controlling the same is required, so that there is a problem of increasing manufacturing costs, and if the dew point is higher than −30° C., annealing oxides are excessively formed on a surface of the steel sheet during annealing, which may cause defects such as non-plating. Therefore, during the continuous annealing, the dew point temperature of the atmospheric gas is preferably −70 to −30° C. A lower limit of the dew point temperature of the atmospheric gas is more preferably −65° C., and still more preferably −60° C. An upper limit of the dew point temperature of the atmospheric gas is more preferably −35° C., and still more preferably −40° C.

The annealed cold-rolled steel sheet is cooled (annealed cooled) from an annealing temperature to 66° C. at a cooling rate of 1° C./s or more. When the cooling rate is less than 1° C./s, a large amount of coarse carbides is formed, and thus the impact energy absorbing capacity of the finally obtained hot-formed member may be deteriorated. Therefore, the cooling rate is preferably 1° C./s or more. The cooling rate is more preferably 1.5° C./s or more, and still more preferably 2° C./s or more. An upper limit of the cooling rate is not particularly limited. However, in terms of suppressing defects in a steel sheet shape, the cooling rate may be 50° C./s or less, more preferably 45° C./s or less, and still more preferably 40° C./s or less.

Meanwhile, before performing the skin pass rolling, plating may be additionally performed on the annealed cold-rolled steel sheet. In the present disclosure, the type and method of plating are not particularly limited, but an example of Al-based plating will be described. In the plating, the annealed cold-rolled steel sheet is cooled, and dipped in an Al-based plating bath to form an aluminum-based plating layer. The composition and plating conditions of the Al-based plating bath are not particularly limited.

However, as a non-limiting example, a composition of a plating bath may comprise, by weight: 6 to 12% of Si, 1 to 4% of Fe, and a balance of Al and other inevitable impurities, and a plating amount may be 30 to 130 g/m$^2$ based on one surface which is commonly applied in the art. When the content of Si in the plating bath composition is less than 6% by weight, there may be a disadvantage in that the plating bath temperature rises excessively to deteriorate the equipment, and when the content of Si thereof is more than 12% by weight, there is a disadvantage in that a heating time for hot forming must be lengthened by excessively delaying alloying. If the content of Fe is less than 1% by weight, plating adhesion or spot weldability may be inferior, and if the content of Fe is more than 4% by weight, dross generation in the plating bath may be excessive, causing poor surface quality. If the plating adhesion amount is less than 30 g/m$^2$ based on one surface, it may be difficult to secure the desired corrosion resistance of the hot-formed member, and if the plating adhesion amount is more than 130 g/m$^2$, excessive plating adhesion amount not only increases manufacturing costs, but also makes it difficult to uniformly plate the steel sheet with a plating adhesion amounting an entire width and length direction of the coil.

Meanwhile, according to another aspect of the present disclosure, as described above, continuous annealing and aluminum-based plating may be performed on a cold-rolled steel sheet, but aluminum-based plating may be performed immediately after pickling on the cooled hot-rolled steel sheet.

Hereinafter, an embodiment of a hot-formed member of the present disclosure will be described in detail. The hot-formed member of the present disclosure can be manufactured by hot press-forming the above-described steel material for hot forming.

A microstructure of the hot-formed member may have a martensite single-phase structure or a mixed structure comprising martensite and 40% by area or less of bainite. Since the martensite is a structure which is effective for securing strength targeted in the present disclosure, the microstructure of the present disclosure may be a martensite single-phase structure. Meanwhile, bainite is a structure having a somewhat lower strength than martensite, but is a structure which does not greatly lower bendability when formed in a martensite base and favorable for securing strength, and thus, in the present disclosure, the member may have a mixed structure comprising less than 40% by area of bainite with the martensite. However, when a fraction of the bainite is more than 40% by area, it may be difficult to secure strength targeted in the present disclosure.

Meanwhile, the microstructure may further comprise one or more of 10% by area or less of ferrite and 5% by area or less of retained austenite. The ferrite and retained austenite may inevitably be formed in the manufacturing process. When the ferrite structure is comprised at more than 10% by area, strength is lowered and bending properties may be greatly deteriorated, and when the retained austenite structure is comprised at more than 5% by area, strength may be lowered or hydrogen incorporated from atmospheric gas during hot forming is increased to cause hydrogen brittleness.

The hot-formed member may have a yield strength (YS) of 800 MPa or more, a tensile strength (TS) of 1000 MPa or more, and an elongation (El) of 3.5% or more.

A change amount of a maximum bending angle of the hot-rolled member of the present disclosure may be 5% or less. The maximum bending angle may be confirmed through a three-point bending test according to a VDA standard (VDA238-100). When the change amount of the maximum bending angle is more than 5%, bendability or impact characteristics may be inferior even with similar physical properties.

Next, an embodiment of a method for manufacturing the hot-formed member of the present disclosure will be described in detail. The manufacturing method described below is only one embodiment outside of all possible embodiments, and does not mean that the hot-formed member of the present disclosure must be manufactured only by the following manufacturing method.

The above-described steel material for hot forming or the steel material for hot forming produced by the above method is prepared, a blank is manufactured, and the blank is heated to a temperature, equal to or higher than an austenite single-phase temperature range, more specifically, to a temperature of Ac3 to 980° C., and then maintaining the temperature for 1 to 1000 seconds.

If the blank heating temperature is lower than the Ac3 temperature, it may be difficult to secure a predetermined strength due to existence of untransformed ferrite. On the other hand, when the heating temperature is higher than 980° C., it may be difficult to secure spot weldability due to excessive oxide formation on a surface of the member. Therefore, the blank heating temperature is preferably Ac3 to 980° C. A lower limit of the blank heating temperature is more preferably Ac3±5° C., and still more preferably Ac3±10° C. An upper limit of the blank heating temperature is more preferably 970° C., and still more preferably 960° C.

If the retention time is less than 1 second, the temperature is not uniform throughout the blank, which can cause material differences for each part, and if the retention time is more than 1000 seconds, it may be difficult to secure spot weldability due to excessive oxide formation on the surface of the member, similarly to excessive heating temperature. Therefore, the retention time is preferably 1 to 1000 seconds. A lower limit of the retention time is more preferably 30 seconds, and still more preferably 60 seconds. An upper limit of the retention time is more preferably 900 seconds, and still more preferably 800 seconds.

Thereafter, the heated and retained blank is hot formed and then cooled to room temperature, thereby finally manufacturing a hot-formed member. In the present disclosure, specific conditions in the hot forming are not particularly limited, and a hot forming method which is commonly known in the art to which the present disclosure pertains is applied as it is. As a preferred example, a mold cooling method may be used.

MODE FOR INVENTION

Next, examples of the present disclosure will be described.

The following examples may be modified in various ways without departing from the scope of the present disclosure to those skilled in the art. The following examples are for understanding of the present disclosure, and the scope of the present disclosure should not be limited to the following examples and should not be defined, but should be defined by the claims described later as well as those equivalent thereto.

EXAMPLE

A steel slab having a thickness of 40 mm having the composition listed in Table 1 below (by weight %, a balance being Fe and inevitable impurities) was manufactured by vacuum melting. After heating the steel slab to 1250° C., hot rolling the slab at a finish hot rolling temperature of 900° C., and coiling the slab at a coiling temperature of 640° C., a hot-rolled steel sheet having a final thickness of 2.5 mm was manufactured. After pickling the hot-rolled steel sheet, cold-rolling was performed at a cold rolling reduction rate of 45% to manufacture a cold-rolled steel sheet. After annealing the cold-rolled steel sheet at a temperature of 780° Ca common annealing temperature, in a 5% hydrogen-95% nitrogen atmosphere, the cold-rolled steel sheet was cooled, and Al-based plating was performed.

In this case, the Al-based plating bath composition was formed of Al-9% Si-2% Fe with a remainder of inevitable impurities, and the plating adhesion amount was 70 g/m$^2$ based on one surface. In order to impart roughness to a surface of the steel sheet, skin pass rolling was additionally performed, and skin pass rolling roll roughness and rolling force were varied in order to impart deviation of roughness. The roll roughness and rolling force applied to each specimen are shown in Table 2.

After the steel sheet manufactured as such was manufactured into a blank, and was hot formed using a mold for hot forming, to manufacture a hot-formed member. In this case, a heating temperature of the blank was 930° C., a retention time thereof was 5 minutes, and a transfer time from a heating furnace to molding was all 10 seconds, which were identically applied.

A yield strength (YS), a tensile strength (TS), and an elongation (EI) were measured by collecting a specimen of an ASTM standard in a direction perpendicular to the rolling direction of the steel sheet, and then performing a tensile test.

Bendability, which is an important index for an impact energy absorption capacity, was evaluated by performing a three-point bending test according to a VDA standard (VDA238-100). By calculating an area until a maximum load is reached from the load-displacement curve obtained from the three-point bending test (crack initiation energy, CIE), the impact energy absorption capacity of the material can be evaluated. FIG. 2 simply illustrates a concept of the CIE, which is a criterion for evaluating the impact energy absorption capacity.

TABLE 1

| Steel Type | C | Si | Mn | P | S | Al | Cr | Mo | N | Ti | B |
|---|---|---|---|---|---|---|---|---|---|---|---|
| A | 0.22 | 0.256 | 1.15 | 0.0095 | 0.0014 | 0.036 | 0.19 | — | 0.004 | 0.0217 | 0.0027 |
| B | 0.29 | 0.65 | 0.52 | 0.0076 | 0.0013 | 0.0332 | 1.71 | 0.17 | 0.0038 | 0.032 | 0.0019 |
| C | 0.32 | 0.4 | 0.87 | 0.0076 | 0.0013 | 0.032 | 3.2 | 0.16 | 0.0038 | 0.026 | 0.0021 |

TABLE 2

| Classification | Steel type | skin pass rolling roll roughness (Ra, roll) (μm) | skin pass-rolling rolling foce (P) (ton) | Relationship 2 $(ton \cdot \mu m)^{1/2}$ | Properties after hot forming YS (MPa) | TS (MPa) | El (%) | Relationship 1 (μm) | Maximum bending angle (°) | Change amount of bending angle (%) | CIE (Nm) |
|---|---|---|---|---|---|---|---|---|---|---|---|
| Inventive Example 1 | A | 4.6 | 150 | 26.3 | 1089 | 1528 | 9.1 | 1.467 | 60.14 | — | 29692 |
| Comparative Example 1 | A | 4.6 | 400 | 42.9 | 1077 | 1527 | 8.5 | 2.262 | 56.00 | −6.89% | 27317 |
| Comparative Example 2 | A | 4.6 | 650 | 54.7 | 1075 | 1523 | 7.9 | 2.939 | 49.97 | −16.91% | 25832 |
| Inventive Example 2 | B | 3.1 | 100 | 17.6 | 1293 | 1864 | 6.3 | 0.944 | 45.02 | — | 49783 |
| Inventive Example 3 | B | 3.1 | 150 | 21.6 | 1299 | 1858 | 6.2 | 1.402 | 44.17 | −1.90% | 48788 |
| Inventive Example 4 | B | 3.1 | 300 | 30.5 | 1296 | 1867 | 6.4 | 1.482 | 43.66 | −3.03% | 46796 |
| Comparative Example 3 | B | 3.1 | 650 | 44.9 | 1297 | 1863 | 6.2 | 1.833 | 39.63 | −11.97% | 42316 |
| Inventive Example 5 | C | 2.6 | 0 | 0.0 | 1316 | 1952 | 7.1 | 1.648 | 42.00 | — | 39566 |
| Comparative Example 4 | C | 2.6 | 650 | 41.1 | 1311 | 1951 | 6.6 | 1.980 | 36.10 | −14.0% | 33631 |
| Comparative Example 5 | C | 2.6 | 700 | 42.7 | 1311 | 1951 | 6.6 | 2.262 | 32.67 | −22.2% | 29674 |

In Table 2, Relationship 1 represents a surface roughness factor, $$\text{Surface Roughness Factor} = \frac{Rt}{100} + 10 \times Rdq$$

where Rt is defined as a vertical distance between a highest peak and a deepest valley in a random measurement section on a surface of a steel sheet, and Rdq is a root mean square of a slope of the peak in a random measurement section on the surface of the steel sheet.

Relationship 2 represents $\sqrt{P \times Ra_{roll}} \leq 40$.

where P is rolling force during skin pass rolling, and $Ra_{roll}$ is arithmetic mean roughness (Ra) of a skin pass rolling roll.

As can be seen from Tables 1 and 2, it could be confirmed that excellent bendability can be secured when a surface roughness factor of 1.8 μm or less is secured by satisfying both the alloy composition and skin pass rolling conditions proposed by the present disclosure.

Specifically, comparing Inventive Example 1 with Comparative Examples 1 to 2, they were all manufactured using the same A steel type, and in Inventive Example 1 satisfying the conditions of the present disclosure, it can be seen that excellent and bendability impact resistance characteristics were secured by securing a maximum bending angle of 60.14° and CIE 29692 Nm. However, Comparative Examples 1 and 2 have strength after hot forming similar to Inventive Example 1, but [Relationship 2], a skin pass rolling condition, was more than an upper limit of 40, so that the surface roughness factor is outside of the scope of the present disclosure. As a result, it was confirmed that a change amount of a bending angle compared to Inventive Example 1 finally was more than 5% due to a surface notch effect, and it was confirmed that there was a decrease in bendability.

Inventive Examples 2 to 4 and Comparative Example 3 were all manufactured using the same B steel type, but Inventive Example 2, satisfying the conditions of the present excellent disclosure, secured bendability and impact resistance, and compared to Inventive Example 2, in all of Inventive Examples 3 to 4, a decrease in maximum bending angle was only 5% or less. However, in Comparative Example 3, the skin pass rolling condition [Relational Expression 2] was more than an upper limit of 40, the surface roughness factor was outside of the scope of the present disclosure, and compared to Inventive Example 3, it is confirmed that the bendability and the impact resistance were significantly reduced.

Inventive Example 5 and Comparative Examples 4 to 5 were manufactured of the same type of C steel, and Inventive Example 5 had a maximum bending angle of 42° C. and was able to secure CIE 39566 Nm. However, in Comparative Examples 4 to 5, the skin pass rolling condition [Relational Expression 2] was more than the upper limit of 40, the surface roughness factor is outside of the scope of the present disclosure, and compared to Inventive Example 5, and it is confirmed that bendability and impact resistance characteristics were reduced by checking a change amount of the bending angle of more than 5%.

Example 2

Steel having steel components shown in Table 3 below was manufactured through the same steelmaking, hot rolling, cold rolling, and annealing processes as in Example 1, and no additional plating was performed. Skin pass rolling was performed to impart roughness to the annealed steel sheet that had passed through the annealing process, and additional electroplating was performed on the skin pass rolled annealed steel sheet to prevent decarburization of a surface layer that may occur during the hot forming process. The steel sheet thus prepared was manufactured to form a blank, and then was hot formed using a mold for hot forming, to manufacture a hot-formed member. In this case, a heating temperature of the blank was 900° C., a retention time was 6 minutes, and a transfer time from a heating furnace to forming was 10 seconds.

TABLE 3

| Steel type | C | Si | Mn | P | S | Al | Cr | N | Ti | B |
|---|---|---|---|---|---|---|---|---|---|---|
| D | 0.222 | 0.26 | 2.15 | 0.013 | 0.0001 | 0.022 | 0.215 | 0.0036 | 0.028 | 0.0018 |

TABLE 4

| Classification | Steel type | skin pass-rolling roll roughness (Ra, roll) (μm) | skin pass-rolling rolling force (P) (ton) | Relationship 2 (ton · μm)$^{1/2}$ | Properties after hot forming YS (MPa) | TS (MPa) | El (%) | Relationship 1 (μm) | Maximum bending angle (°) | Change amount of bending angle (%) | CIE (Nm) |
|---|---|---|---|---|---|---|---|---|---|---|---|
| Inventive Example 6 | D | 2.6 | 100 | 16.1 | 1266 | 1607 | 4 | 0.976 | 58.5 | — | 30376 |
| Inventive Example 7 | D | 2.6 | 150 | 19.7 | 1287 | 1600 | 3.9 | 1.369 | 56.9 | −2.74% | 29161 |
| Inventive Example 8 | D | 2.6 | 300 | 27.9 | 1289 | 1595 | 3.8 | 1.755 | 55.6 | −4.96% | 28553 |
| Inventive Example 6 | D | 2.6 | 650 | 41.1 | 1287 | 1603 | 3.8 | 1.882 | 54.7 | −6.50% | 27338 |

In Table 4, Relationships 1 and 2 are the same as those of Table 2 in Example 1 described above.

In Table 4, looking at Inventive Examples 6 to 8 and Comparative Example 6 made of steel type D in Table 3, it was confirmed that Inventive Example 6 had very good bendability with a maximum bending angle of 58.5°. Inventive Examples 7 and 8 also satisfy the conditions of the present disclosure, and have a change amount of a bending angle compared to Inventive Example 6, but it can be confirmed that they all have good bendability or impact resistance of 5% or less.

On the other hand, in the case of Comparative Example 6, it was manufactured using the same D steel type, and despite showing strength after hot forming, the alloy composition satisfied the scope of the present invention, but the value according to Relationship 2 was more than 40, and as a result, the surface roughness factor was outside of the scope of the present invention, resulting in a change amount of the bending angle exceeding 5% compared to Inventive Example 6 due to a surface notch effect.

While example embodiments have been shown and described above, it will be apparent to those skilled in the art that modifications and variations could be made without departing from the scope of the present disclosure as defined by the appended claims.

The invention claimed is:

1. A steel material for hot forming comprising, by weight:

0.04 to 0.45% of carbon (C); 1.5% or less of silicon (Si) (excluding 0%); 0.2 to 2.5% of manganese (Mn); 0.05% or less of phosphorous (P); 0.02% or less of sulfur(S); 0.01 to 0.1% of aluminum (Al); 0.01 to 5.0% of chromium (Cr); 0.02% or less of nitrogen (N), and a balance of iron (Fe) and inevitable impurities, wherein the steel material is in a form of a steel sheet, and wherein a surface roughness factor calculated by following [Relationship 1] is 1.648 μm or less, $$\text{Surface Roughness Factor} = \frac{Rt}{100} + 10 \times Rdq \qquad \text{[Relationship 1]}$$

where Rt is defined as a vertical distance between a highest peak and a deepest valley in a random measurement section on a surface of the steel sheet, and Rdq is a root mean square of a slope of the peak in a random measurement section on the surface of the steel sheet.

2. The steel material for hot forming of claim 1, wherein the steel material further comprises: one or more of 0.5% or less of Mo; 0.5% or less of Ni; 0.1% or less of Nb, 0.1% or less of Ti, and 0.01% or less of B.

3. The steel material for hot forming of claim 1, wherein a microstructure of the steel material comprises, by area fraction, one or more of 50 to 90% of ferrite; 30% or less of pearlite; 20% or less of bainite, and 20% or less of martensite.

4. The steel material for hot forming of claim 1, wherein the steel material further comprises a plating layer.

5. The steel material for hot forming of claim 4, wherein the plating layer comprises, by weight: 6 to 12% of Si; 1 to 4% of Fe, and a balance of Al and inevitable impurities.

6. The steel material for hot forming of claim 1, wherein the surface roughness factor calculated by Relationship 1 is 0.976 μm or less.

* * * * *